US006572219B1

(12) United States Patent
Sundström

(10) Patent No.: US 6,572,219 B1
(45) Date of Patent: Jun. 3, 2003

(54) PRINT HEAD FOR ELECTROSTATIC PRINTING

(75) Inventor: Per Sundström, Järfälla (SE)

(73) Assignee: Digital Filter Printing AB, Jarfalla (SE)

( * ) Notice: Subject to any disclaimer, the term of this patent is extended or adjusted under 35 U.S.C. 154(b) by 0 days.

(21) Appl. No.: 10/069,131

(22) PCT Filed: Aug. 23, 2000

(86) PCT No.: PCT/SE00/01622

§ 371 (c)(1),
(2), (4) Date: Jun. 6, 2002

(87) PCT Pub. No.: WO01/14144

PCT Pub. Date: Mar. 1, 2001

(30) Foreign Application Priority Data

Aug. 25, 1999 (SE) ..... 9903000

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS 5,404,159 A 4/1995 Ohashi

*Primary Examiner*—Raquel Yvette Gordon
(74) *Attorney, Agent, or Firm*—Larson & Taylor PLC

(57) ABSTRACT

Print head for electrostatic printing of documents in accordance with the so called aperture technique (DFC=Digital Control Filter) comprising means (14, 16, 17) for charging toner particles (2) with a certain polarity, a toner depositing matrix (3), which is provided with a number of toner depositing apertures (6), through which toner particles (2) are able to pass, means (5, 8) for controlling the deposit of toner particles to certain predetermined deposit positions, and means for feeding a document (7) to be printed below the toner deposit matrix (3). The means for charging the toner particles (2) with a certain polarity comprise two co-operating brushes, viz. a feeding brush (14) and a flipping brush (16) to bring the toner particles (2) to be charged by the fibers rubbing against the toner particles, and a flipper blade (17) is situated adjacent to the exit for the flipping brush (16), which blade flips toner particles (2) from the brush fibers (16*a*) so that there is created a cloud of charged toner particles (2), which are attracted against the aperture matrix (3, 4) and by electric attraction are controlled by an individual blocking field (4, 5, 10) for every aperture (6) in the aperture matrix (3), which blocking field is arranged to open and close, respectively, the toner deposit apertures (6) individually in an electric manner.

13 Claims, 2 Drawing Sheets

PRINT HEAD FOR ELECTROSTATIC PRINTING

FIELD OF THE INVENTION

This invention relates to a print head for electrostatic printing of documents in accordance with the so called aperture matrix technique, which usually is called DCF-technique being an abbreviation of Digital Control Filter technique, which print head includes means for charging of tuner particles with a certain polarity, a tuner depositing matrix which is provided with a plurality of apertures, trough which the toner particles can pass, means for controlling the deposit of tuner particles to certain specific depositing positions, and means for feeding a document, which in to be printed under the aperture matrix.

PRIOR ART

During approximately the last 10 to 15 years work has proceeded to simplify the so-called laser printer technique. Characteristic of his technique is that a digitalized picture is applied on a rotating, light sensitive drum by means of digitalized light. Then different electrical levels on the drum surface will represent the picture, subsequently the picture is developed by electrically charged powder, and finally the picture is moved to the document by pressure transfer. Pressure and heat between a pair of rollers fix the digitalized picture now existing on the document.

The characterising feature of this printing technique is that a pulverised dry ink is used, which generally is called a toner and is fixed to the documents by a fuse-pressure process, whereby the document is provided with an excellent durability for a long time and resistance to external influence by mechanical wear and moisture etc.

The present simplifying proceedings is to eliminate the previous intermediate step of storing the picture on a drum, where it is developed and later moved to the document This involves unnecessary costs due to additional components and an increased risk for distorting the digital information on its way from the computer to the state, in which is fixed on a document.

The most recently developed laser printers provide a picture quality of 600 DPI (dots per inch) or better. To cover an A4 page with all possible dot positions 34 million positions are required at a resolution of 600×600 DPI. The problem is to find a technique by which it is possible to apply a powder dot in the shape of a small dot on the correct location on the document, when there are 34 million possibilities.

The most successful technique during the last few years is to use a so-called "Digital Controlled Filter" (DCF), henceforth called a matrix or an aperture matrix, comprising a row of small apertures in a thin foil. The apertures are opened or closed by application of an electrical voltage, which generates a field that attracts the electrically charged powder to pass or not to pass through the apertures. On one side of the foil the document is situated, upon which the particles land, and on the other side of the foil the charged powder is situated on a conveyor. In most applications this conveyor consists of a roller with a thin layer of electrically charged powder.

This technique was described for the first time in the U.S. Pat. No. 3,689,935 to Pressman and Casanova in Sep. 5, 1972. Several later patents disclose various improvements of the Pressman/Casanova patent, e.g. U.S. Pat. No. 4,491,855

(Fuji/Ando—Canon from 1985), U.S. Pat. No. 4,912,489 (Schmidlin—Xerox from 1990) and Swedish patent No. 8704883-1 (Ove Larsson—Array Printers from 1989). The various improvement methods disclosed in these patents relate to how the electrical field around each aperture is appplied to obtain a more efficient transfer of the powder through the apertures down to the document.

Problem

An aperture matrix may comprise a row of apertures covering the width of an A4 sheet, i.e. 210 mm or a row of 4960 apertures to create a 600 DPI print-out. The advantage with this type of aperture matrix is that printing can be done with continuous paper feed and with continuous fixing, and in other words a continuous printing process is obtained.

There are many problems connected with an aperture matrix being as wide as said 210 mm.

1. If every aperture is connected with a drive circuit for the application of a voltage on a round electrode, which is arranged around the aperture, this involves several thousands ring electrodes, connection lines and drive circuits, and with increasing number of apertures in the aperture matrix the probability increases for breakdown in any of these apertures, rings, connection lines or drive circuits.
2. If the control field for opening and closing the apertures in the aperture matrix is applied between ring electrode and powder feed surface there is an additional problem, for the distance between the aperture matrix and the powder feed must have the magnitude of 0.1 to 0.15 mm, since available drive circuits can stand a maximum of 300 to 350 volt. Therefore this distance is not allowed to vary more than 0.02–0.04 mm since the variation of the distance has an influence on the electrical filed, which in turn has an influence on the blackness of the printout. Since the aperture matrix is a thin foil it is very difficult to maintain a distance of 0.1 to 0.15 mm within the said tolerance between the aperture matrix an the powder feed surface over the entire width of an A4 sheet.
3. According to paragraph 2 drive circuits are required, which can stand at least 300 volts and preferably more, and such drive circuits in the form of integrated circuits are still too expensive, which creates a cost problem. The solution of the cost problem is to use lower voltage or fewer circuits.
4. A further problem is that there exists a certain percentage of powder, which not will be charged or charged to the opposite potential. This powder can not be controlled by electric control fields but will fly around without control or deposit on undesirable surfaces.

Common types of printing powder will be electrically charged with negative potential, when the powder particles rub against some other suitable material. This rubbing is usually created in two ways, either with a rotating magnetic field in case the powder is provided with magnetite and a rotating magnetic brush is created, which rub the particles against a roller. In case the powder lacks magnetite a rotating brush or a foam rubber roller, which rotates against a steel roller, rubs the powder particles against this steel roller. In booth cases the correct amount of powder is dosed on the rotating steel roller by means of a flexible rubber blade. This dosing, called doctoring, has a grinding influence on the powder, and the disintegration of powder particles causes creation of particles, which are booth incorrectly charged and uncharged.

The four main problems mentioned above are the reason for the fact that the technique mentioned above not yet has been any great commercial success, though it offers direct transfer of digital information from a computer to a document.

The Invention

Our proposal is to use an aperture matrix comprising en isolating foil with a completely covering, electrically conducting surface on one side of the foil (called the base side). On the other side of the foil there are a greater number of electrically conducting rings (called ring side), each of which is formed around an aperture through the aperture matrix. Each ring is connected to a voltage source through a separate line to a control transistor. The base side of the foil has a common potential, since it has a completely covering, electrically conducting surface.

According to the invention it is proposed that the electrically charged powder now is applied above the base side on the aperture matrix as a cloud of charged particles, which constantly are moving. This cloud is created in such a way, that toner which is situated in a toner container, is fed forwards by a feeding brush, which rotates clockwise (in the case shown in FIG. 2) with a low number of revolutions to correspond with the consumption of tuner in the printing process.

Tangential to the feeding brush is a flipping brush, which rotates anticlockwise with a higher number of revolutions than the feeding brush. In the tangential point between these brushes stirring of the particles occur due to the difference in number of rotations between the brushes.

The mission of the feeding brush is to control, dependent on its number of revolutions, that the amount of tuner in the flipping brush is on the right level in order to guarantee that the toner concentration in the toner cloud not varies due to variations of the amount of tuner in the flipping brush.

To provide a negative charge of tuners, the fibres of either the flipping brush or in booth the feeding brush and the flipping brush consist of a material, which is triboelectrically positive with respect to the toner. When the particles collide with the brush fibres in the moment of stirring, the fibres become positively charged and the toner negatively charged. The flipping brush gets a positive charge and the toner particles will stick to the brush straws. The flipping brush will continue to rotate, with the straws filled with toner particles, on to a metal blade, which bends the straws backwards, and when the straws pass the edge of the blade, the straws will flip and become straight, whereby the toner particles are shaken off and a toner cloud is formed. In this toner cloud the particles move downwards towards the aperture matrix.

It is important that the flipping brush is situated on the same centre line, which extends through the centre of the aperture zone in the aperture matrix, so that the toner cloud, which is formed, will be as homogeneous as possible over the entire width of the aperture zone. The distance between the periphery of the flipping brush and the upper side of the base side of the aperture matrix should not exceed 0.5 mm. This distance is of importance to maintain correct toner density in the toner cloud.

The particles, which are not used in the printing process, may either mechanically bounce back to the flipping brush or by means of electronical forces move back to the flipping brush, which is positively charged, and also up towards the edge of the flipping brush housing, which also is positively charged.

Due to the fact that the flipping brush is semi-resistive and the central shaft of the flipping brush is connected to a positive voltage, there exists a field between the base side of the aperture matrix and the fibres of the flipping brush. Now this field shall have such direction, that it lifts the negatively charged toner back into the brush. This returning force must be of the same order of magnitude as the flipping force, so that approximately the same amount of tuner returns to the brush as the amount of tuner coming out from the brush reduced by the amount of tuner which is transported downwards through the apertures. Also the front edge of the brush housing surrounding the flipping brush, is preferably connected to the same positive voltage as the centre shaft of the flipping brush, so that tuner, which not manages to return to the brush, will get stuck there and successively is fed back into the brush.

As an alternative proposal the centre shaft of the flipping brush is connected to en alternating voltage being 180° out of phase in relation to the printing process. When the apertures are open practically no toner is returned to the brush. When the apertures are closed, however, maximal amount of tuner is returned to the brush. This function is controlled by the computer card of the print unit, so that these fields are synchronised (see FIG. 3).

These toner particles will now follow the flipping brush back to the tangential point between the brushes, where the particles are mixed with new particles and recharged.

Booth brushes are surrounded by a housing, which tightly fits around the periphery of the brushes. The reason for this is that toner, being fed forwards by the brushes, shall advance and that no tuner shall spatter out from the brushes due to centrifugal force when the brushes rotate. Thereby control is secured that all charged tuner will arrive in the proper place. The housings around the brushes also provide a possibility of changing the brushes when the toner container is changed. Thereby a new set of brushes will be provided every time the toner container is changed, and the risk of worn out and damaged brushes is reduced.

On the ring side of the aperture matrix the document is situated, and under the document there is a back electrode, which is connected to a positive potential of 1000–2000 volts. Between this back electrode an the base side of the aperture matrix, which has the level of zero volt, there is formed an electric field, called the main field, through the apertures in the aperture matrix, and around the aperture edge on the base side of the aperture matrix an edge field will be formed. This edge field is directed in such a manner, that toner particles moving down through the aperture when the ring around the aperture on the aperture side is at zero volts. If the ring around the aperture is at minus 100–200 volts, the edge field gets the opposite direction, whereby a barrier field is created.

The toner particles in the toner cloud are not able to move downwards through the apertures.

The toner particles, which are located in or closely below the aperture, will now move upwards through the hole back into the toner cloud, and the aperture will be blocked for tuner in the cloud.

If the ring is at zero volts, the main field will accordingly drive tuner from the cloud down through the aperture to the document, but if the ring has a negative potential of 100–200 volts the blocking field will block transport of tuner, and no tuner will pass through the aperture.

The patent U.S. Pat. No. 5,404,159 discloses an arrangement, by means of which printing is provided by a toner cloud. This prior art arrangement, however, is different from the present invention mainly through the way a stable tuner cloud is created:

in the present arrangement there is firstly used a feeding brush, the task of which is to feed a controlled amount of tuner to a flipping brush, so that the flipping brush receives the correct toner concentration to cerate a prerequisite for the correct toner concentration in the toner cloud;

the flipping brush is contacting the feeding brush to create a charge between the brush fibres of the flipping brush and the toner, so that toner shall stick to the brush fibres by electrical force;

the flipping brush is centrally arranged with respect to the aperture zone to create a homogeneous toner cloud in relation to all aperture positions in the aperture matrix;

the flipping brush is semi-resistive and connected to a positive potential to create en electric field between the upper side of the aperture matrix and the brush, that actively feeds such tuner back which not has been used in the printing process;

the brushes are enclosed in a housing, the task of which is to secure that all of the tuner arrives at the means for generating the tuner cloud, whereby the housing contributes to the achievement of a stable toner concentration in the toner cloud.

DETAILED DESCRIPTION WITH REFERENCE TO THE DRAWINGS

The invention is illustrated in the accompanying drawings, of which

Figure 1:
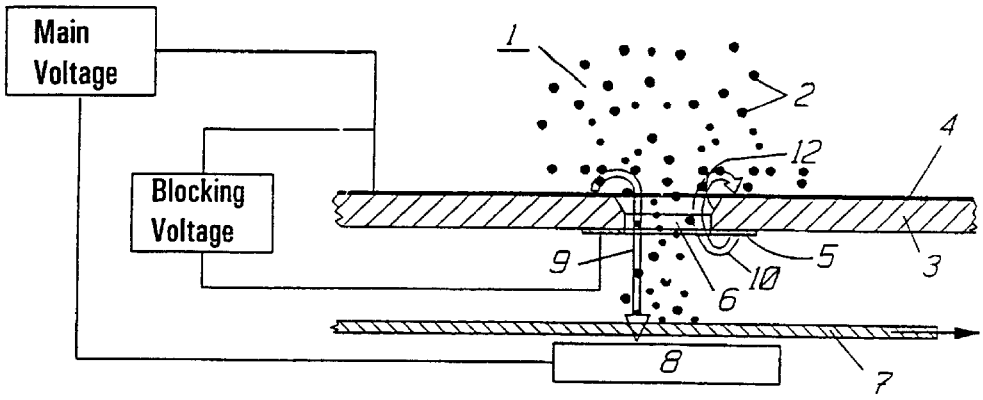
FIG. 1 shows a first example of the principle of the print head in accordance with the present invention.

FIG. 1 shows schematically and partly in cross section a print head not having rotating brushes or any equivalence thereof. The figure shows how a cloud 1 is created by (generally negatively) charged powder particles 2, which move above and in contact with an aperture matrix 3. The main field 9 for powder feeding is now positioned between the base side 4 (upper side) on the aperture matrix 3 and a back electrode 8 on the bottom side of a document 7 to be printed, whereas a blocking field 10 is positioned, in the same way as in prior art, between conducting rings 5 and the base side 4 of the aperture matrix 3. The electrical edge field, which is created around the edges of the apertures 6 in the aperture matrix 3 on its base side 4, will attract the charged toner particles 2 in the powder cloud 1. In order to prevent flashover between rings 5 and through apertures 6 to the base side 4, all rings 5 on the ringside of the aperture matrix and all apertures 6 should be electrically isolated, which can be done with Parylene® or similar isolation. The isolation may have a thickness of approximately 5–15 $\mu$m. The apertures 6 in the aperture matrix 3 on the base side 4 may preferably be designed with an upper feeding funnel portion 12 to improve the capture of particles 2 from the powder cloud 1 above the aperture matrix 3 into the matrix aperture 6. This has the advantage of a better degree of exploitation of the powder cloud 1.

The (generally) negatively charged powder particles 2 in the powder cloud 1 move above the aperture matrix 3. The base side 4 of the aperture matrix is normally connected to zero volts. Under the document 7 there is a back electrode 8, which maintains a voltage of 1000–2000 volts. Thereby a field is created between the back electrode 8 and the edge on the base side 4 around the matrix aperture 6. This field is called the main field 9. The main field extends trough the aperture 6 up to the base side 4, and an edge field is created around the matrix aperture 6. This edge field will attract the powder particles 2 and make them move downwards through the matrix aperture 6 and further down to the document 7.

When the current-conducting ring 5 obtains a negative potential there is created a field through the matrix aperture 6, called the blocking field 10, which blocks the aperture 6 against downfall of tuner particles. This is caused by the fact that the blocking field 10 in the matrix aperture 6 has opposite direction in relation to the main field, and now no powder particles can move down through the matrix aperture 6. When the powder particles 2 pass over an aperture 6 in the aperture matrix 3, and the current-conducting ring 5 around the aperture 6 is on the same voltage level as the base side 4, there exists no field between the ring 5 and the base side 4. Between the base side 4 and the back electrode 8 there is then created a field trough the aperture 6, called the main field 9. This field is strong enough to move the negatively charged powder particles from the powder cloud 1 down to the document 7.

Figure 2:
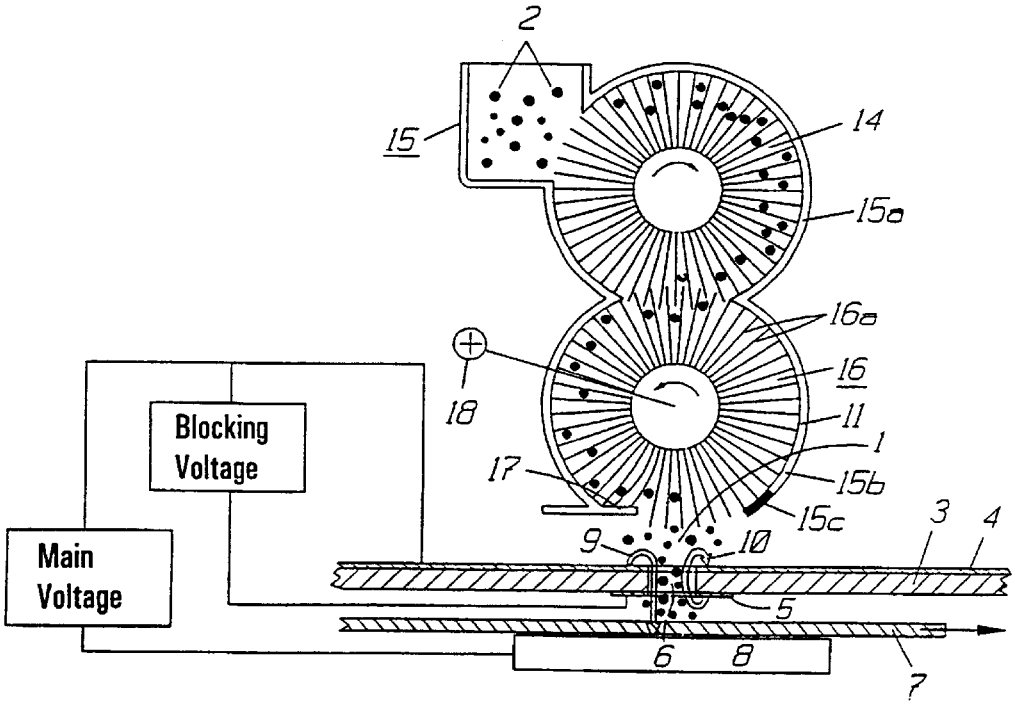
FIG. 2 shows a system for transport, charging and cloud generation of the tuner particles in the print head by means of rotating brushes.

FIG. 2 shows an embodiment of a mechanical powder feeder, charger and cloud creator. The arrangement comprises a feeding brush 14, which is mounted adjacent to the orifice of a powder container 15 and rotates clockwise while slowly feeding new toner powder 2 with the same rate as the toner powder is consumed by the print process.

The feeding brush is enclosed in a housing 15*a* in order to feed toner emitted from the toner container 15.

A flipping brush 16 in mounted so that it is contacting the feeding brush 14, but it rotates with a much higher peripheral speed than the feeding brush 14 and in anticlockwise direction. At the contact between the feeding brush 14 and the flipping brush 16 the powder particles 2 will rub against the brush fibres 16*a* of the flipping brush 16. These brush fibres 16*a* must be made of a material which triboelectrically gives the fibres a positive charge and the toner a negative charge.

Then the negatively charged particles 2 will stick on the positively charged straws 16*a* of the flipping brush 16. The brush arrangement also comprises a flipper blade 17. When the straws 16*a* of the flipping brush 16 with the powder particles 2 arrive to the flipper blade 17, the straws are bent backwards, and when the straw tip passes the flipper blade 17, the straw flips and throws the negatively charged powder particles 2 down towards the surface of the aperture matrix.

It is essential that the flipping brush 16 is arranged in the centre of the aperture zone 6 and that the distance between the brush 16 and the upper side of the aperture matrix 3 does not exceed 0.5 mm. The flipping brush 16 is enclosed in a housing 15*b* to secure that all toner in the flipping brush 16 is fed to the flipper blade 17 to secure that the concentration of tuner is maintained stable in the powder cloud 1.

In that way there is created a cloud 1 of powder above the aperture matrix 3, which cloud is floating above the aperture zone 6 of the aperture matrix 3.

Owing to the positioning of the flipping brush 16 in relation to the aperture zone 6, and owing to the fact that both the feeding brush 14 and the flipping brush 16 are enclosed in housings 15*a* and 15*b*, respectively, it is ensured that the tuner concentration in the toner cloud is uniform over the entire aperture zone 6.

To ensure a stable toner concentration in the powder cloud 1 the central shaft of the brush and the front edge 15*c* of the brush housing 15*b* are connected to an electrically positive voltage level 18.

Due to the fact that an electrical field is created between the flipping brush 16 and the upper side 4 of the aperture matrix 3, which field has such direction that toner, which not has been fed down through the matrix apertures 6, will be returned to the flipping brush 16 and also to the front edge 15*c* of the brush housing 15*b*, where the straws 16 can capture the toner and bring it back to the contact point between the feeding brush 14 and the flipping brush 16 for recharging the particles.

Figure 3:
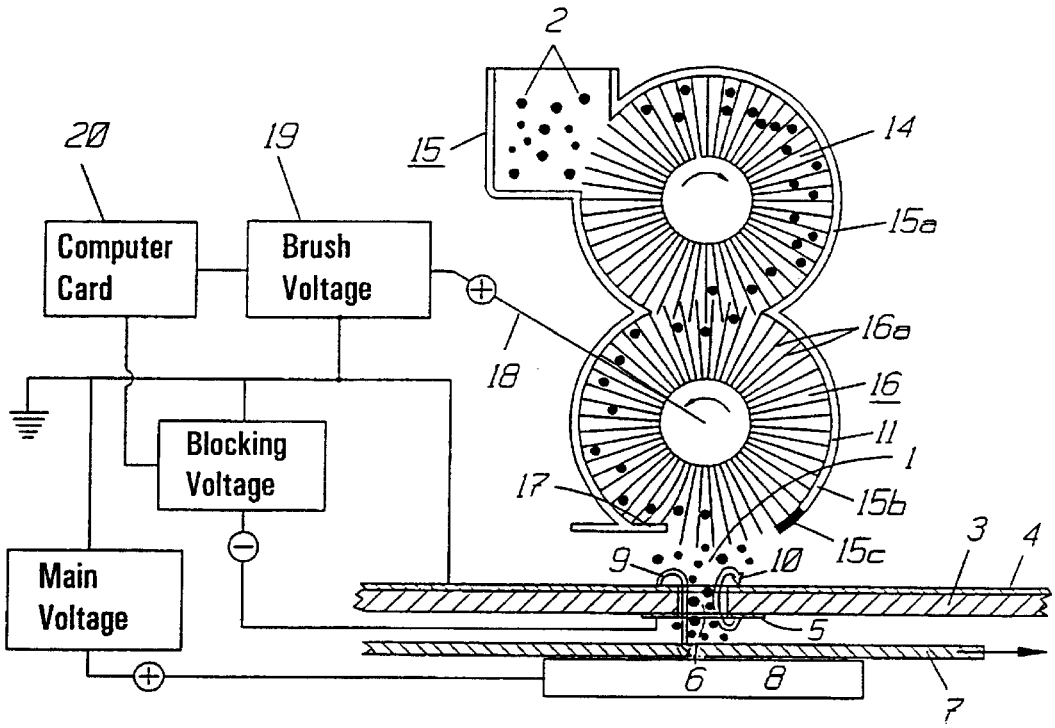
FIG. 3 shows an example of an alternating voltage excitation of the print brush returning toner to the print brush between each print cycle.

In FIG. 3 there is shown an alternative arrangement for voltage excitation of the flipping brush 16. The voltage unit 19 provides an alternating voltage to the flipping brush 16, so that the field, which lifts tuner back to the flipping brush 16, has a maximum value when all of the apertures in the aperture matrix 3 are closed and has a minimum value during the period, in which the apertures shall be open. This is controlled by means of data in a computer card 20. In other words, the return field is alternating synchronously with the print cycle but is 180° out of phase with respect to the print cycle.

In this manner the toner concentration may be maximum during the period when the apertures are open. In order not to overfill the powder cloud, the return feed takes place during that time when the apertures are closed between two openings of the apertures.

Designation numerals

| | | | |
|---|---|---|---|
| 1 | powder cloud | 15 | powder container |
| 2 | powder particles | 15a | housing for feeding brush |
| 3 | aperture matrix | 15b | housing for flipping brush |
| 4 | base side | 15c | front edge of the brush housing |
| 5 | current conducting ring | 16 | flipping brush |
| 6 | matrix aperture | 16a | brush straws |
| 7 | document | 17 | flipper blade |
| 8 | back electrode | 18 | positive connection |
| 9 | main field | 19 | brush voltage unit |
| 10 | blocking field | 20 | computer card |
| 11 | brush housing | | |
| 12 | funnel shaped portion | | |
| 14 | feeding brush | | |

What is claimed is:

1. Print head for electrostatic printing of documents in accordance with the so called aperture matrix technique (DFC=Digital Control Filter) comprising means for charging toner particles with a certain polarity, a toner depositing matrix, which is provided with a number of toner depositing apertures, through which toner particles are able to pass, means for controlling the deposit of toner particles to certain pre-determined deposit positions, and means for feeding a document to be printed below the toner deposit matrix, wherein the means for charging the toner particles with a certain polarity comprise two co-operating brushes, viz. a feeding brush and a flipping brush to bring the toner particles to be charged by the fibers rubbing against the toner particles, and wherein a flipper blade is adjacent to the exit for the flipping brush, which blade flips toner particles from the brush fibers so that there is created a cloud of charged toner particles, which are attracted against the aperture matrix and, by electric attraction, are controlled by an individual blocking field for each aperture in the aperture matrix, which blocking field is arranged to open and close, respectively, the toner deposit apertures individually in an electric manner.

2. Print head according to claim 1, wherein the individual blocking field is produced between an electrically conducting base layer on the upper side of the toner deposit matrix and an electrically conducting ring on the bottom side of the toner deposit matrix.

3. Print head according to claim 2, wherein each conducting ring on the bottom side of the toner deposit matrix is connected to blocking means, which are arranged to open the toner deposit aperture individually at neutral voltage and close the aperture at negative voltage excitation and create a blocking field for the aperture between the ring on the bottom side of the matrix and the base layer on the upper side of the matrix, which field prevents depositing toner particles through the toner deposit aperture.

4. Print head according to claim 1, wherein the feeding brush is enclosed in a housing for feeding downwards a defined amount of toner to the flipping brush, which also is enclosed in a housing for feeding downwards a defined amount of toner to the powder cloud.

5. Print head according to claim 4, wherein the feeding brush with a portion of the brush periphery is in contact with the flipping brush, the brush fibers of which are made of such a material that they tribo-electrically charge the toner particles negatively, whereas the brush fibers become positively charged.

6. Print head according to claim 1, wherein the flipping brush is centrally located over the toner deposit apertures to provide uniform distribution of the toner cloud over the aperture zone.

7. Print head according to claim 6, wherein the distance between the flipping brush and the toner deposit apertures in the toner matrix is 0.5 mm or less.

8. Print head according to claim 1, wherein the brush straws of the flipping brush are semi-resistive, and that the central shaft of the brush is connected to a positive voltage.

9. Print head according to claim 1, wherein the front edge of the housing of the flipping brush is connected to a positive voltage, so that an electrical field is created between the edge of the brush housing and the base side of the aperture matrix.

10. Print head according to claim 9, wherein the electrical field between the edge of the brush housing and the base side of the aperture matrix has a size of such order of magnitude, that it influences the toner particles with the same force as the flip force from the flipping brush.

11. Print head according to claim 1, wherein a voltage power unit is arranged to provide the flipping brush with such alternating voltage, that the field, which lifts the toner back to the flipping brush has a maximum value when all apertures in the aperture matrix are closed and a minimum value during that period when the apertures in the aperture matrix shall be open.

12. Print head according to claim 11, wherein the voltage excitation of the flipping brush is controlled by a computer card in such manner, that the return field for the toner is alternating synchronously with the print cycle and is 180° out of phase with respect to the print cycle.

13. Print head according to claim 1, characterized in, that below the document to be printed there is a back electrode, which creates a main field producing a pull downwards of charged toner particles towards the upper side of the document.

* * * * *